United States Patent [19]

van Herpen

[11] Patent Number: 4,970,832

[45] Date of Patent: Nov. 20, 1990

[54] EAVES SECTION SYSTEM

[75] Inventor: Frederik C. van Herpen, Burgh-Haamstede, Netherlands

[73] Assignee: Alprokon Promotie & Ontwikkeling B.V., Netherlands

[21] Appl. No.: 422,790

[22] Filed: Oct. 17, 1989

[30] Foreign Application Priority Data

Oct. 18, 1988 [NL] Netherlands ..... 8802571

[51] Int. Cl.[5] ..... E04D 1/36

[52] U.S. Cl. ..... 52/60; 52/96; 52/62

[58] Field of Search ..... 52/11, 13–15, 52/58, 60, 62, 94, 95, 96

[56] References Cited

U.S. PATENT DOCUMENTS

| | | | |
|---|---|---|---|
| 4,067,152 | 1/1978 | Wolma | 52/58 X |
| 4,335,546 | 6/1982 | Kelly | 52/58 |
| 4,592,176 | 6/1986 | van Herpen . | |
| 4,848,045 | 7/1989 | Nichols et al. | 52/60 |

FOREIGN PATENT DOCUMENTS

| | | | |
|---|---|---|---|
| 1609970 | 7/1970 | Fed. Rep. of Germany | 52/60 |
| 1759054 | 5/1971 | Fed. Rep. of Germany . | |
| 3520640 | 11/1986 | Fed. Rep. of Germany . | |
| 1494031 | 9/1967 | France . | |
| 1556699 | 2/1969 | France . | |
| 8501985 | 2/1987 | Netherlands . | |
| 8702662 | 1/1988 | Netherlands . | |
| 1347974 | 2/1974 | United Kingdom | 52/94 |

*Primary Examiner*—Richard E. Chilcot, Jr.
*Assistant Examiner*—Lan Mai
*Attorney, Agent, or Firm*—Ostrolenk, Faber, Gerb and Soffen

[57] ABSTRACT

Eaves section system comprising a first section part with a covering strip, a downward-directed covering flange at right angles thereto an upright rib and a second section part which encloses said rib, is coupled to the first section part and is provided with a second covering strip above the first covering strip and with at least one coupling piece to be fitted between the first and second covering strip, and which is on the one hand to be coupled to the first section part, and to which on the other hand the second covering strip is to be locked.

12 Claims, 4 Drawing Sheets

EAVES SECTION SYSTEM

BACKGROUND OF THE INVENTION

The invention relates to an eaves section system comprising a first section part with a covering strip to be fitted on the roof covering material, a downward-directed covering flange chiefly at right angles thereto and to be fitted in front of the outside wall of the roof, an upright rib and a second section part which encloses said rib, is coupled to the first section part and is provided with a second covering strip above the first covering strip. Such an eaves section system is known in practice as the "double trim system" and is described, for example, in EP-A-0 312 896.

Although this double trim system was found in practice to be a considerable improvement compared with the known systems, the object of the invention is to improve the known eaves section system even further in the sense that the system requires fewer preliminary operations and can be fitted with fewer actions, while improved protection against the penetration of water is obtained.

SUMMARY OF THE INVENTION

This object is achieved by providing at least one coupling piece which is to be fitted between the first and second covering strip, and which is on the one hand to be coupled to the first section part, and to which on the other hand the second covering strip is to be locked.

Preferably this coupling piece runs to the front end of the first covering strip, while the second covering strip is to be locked by the front end thereof on the front end of the coupling piece.

In a preferred embodiment the front edge of the second covering strip is flanged inwards and for locking purposes fits into at least one recess formed in a resilient part of the front end of the coupling piece.

Preferably the front end of the coupling piece carries two lips which project in a V-shape therefrom and can be bent out resiliently, and each of which is provided with a locking recess. The upright rib preferably bears an outward-directed locking rib, cooperating with an inward-directed locking rib engaging behind it and disposed on the part of the second section part which encloses said rib.

In a preferred embodiment the upright rib has an end edge including an acute angle therewith and facing the end of the strip, and the coupling piece is provided on a first end with a raised end edge fitting into the space between said end edge and the top surface of the covering strip.

The first covering strip is preferably provided near the front end with a rib receding at an acute angle, and near the front end and at the bottom side the coupling piece is provided with a snap-in edge fitting in behind it.

The eaves section system according to my invention may be provided with a coupling piece with a prismatic body part whose top face slopes away between the side walls from the rear end towards the front end of the body part. Preferably projecting from this top wall is a lobe which, when the system is fitted, extends to the top face of the second covering strip and limits the distance between two adjacent second covering strips.

While in the section system according to the state of the art the top section part is fixed on the bottom section part by means of locking screws going through one of the legs and acting on an upright part of the first section part, for which threaded holes have to be tapped in the first section part, the invention proposes to use coupling pieces, which greatly facilitates the fitting of the first section part on the eaves. The first section parts can now be supplied in discrete lengths to the user, accompanied by the correct number of coupling pieces, which have to be fitted at the correct intervals by the user and, of course, without the covering strip of the section being pre-drilled at specific intervals. This eliminates not only a preliminary processing operation, but also an unpacking and packing operation: the parts can be delivered directly from the extrusion site to the user.

DESCRIPTION THE DRAWINGS

Figure 1:
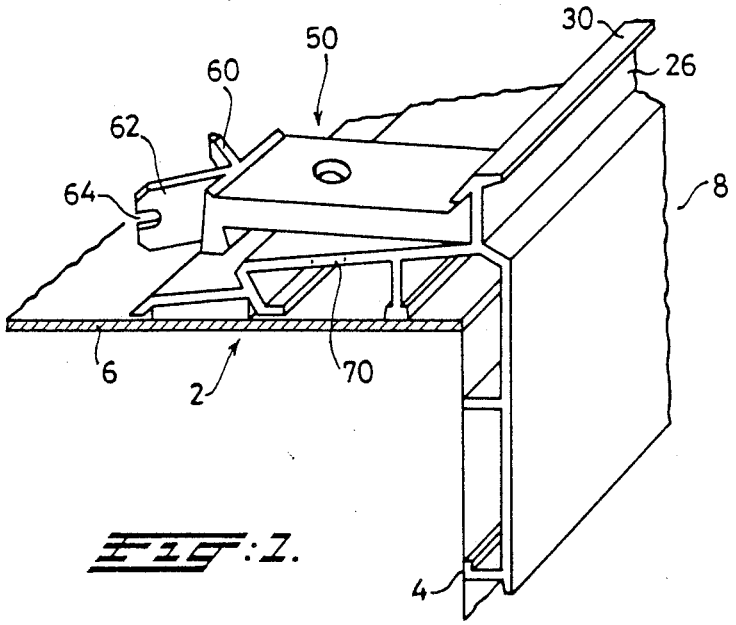
FIG. 1 shows a perspective view of the first section part of the eaves section system according to the invention, with coupling piece.
Figure 2:
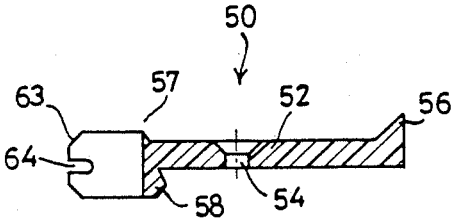
FIG. 2 shows a side view of said coupling piece.
Figure 3:
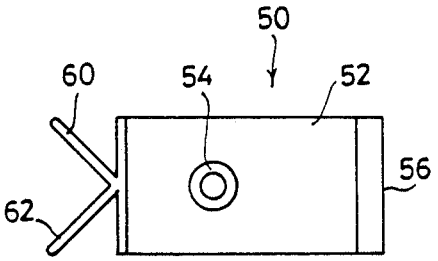
FIG. 3 shows a top view of said coupling piece.
Figure 5:
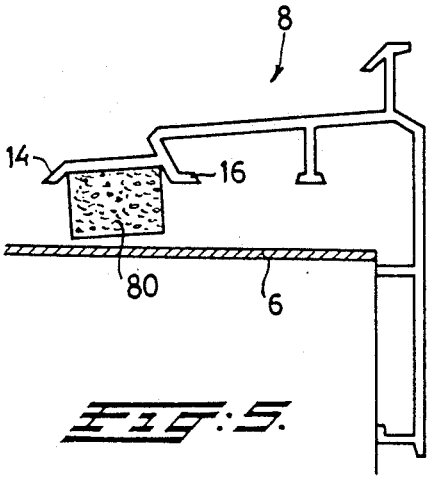
Figure 6:
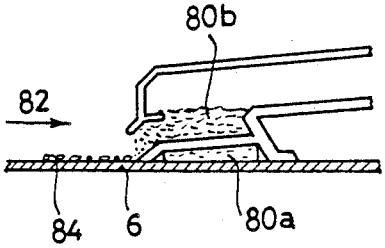
Figure 4C:
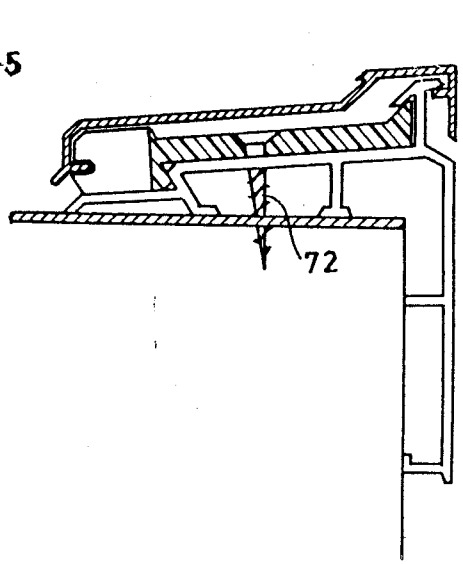
Figure 4B:
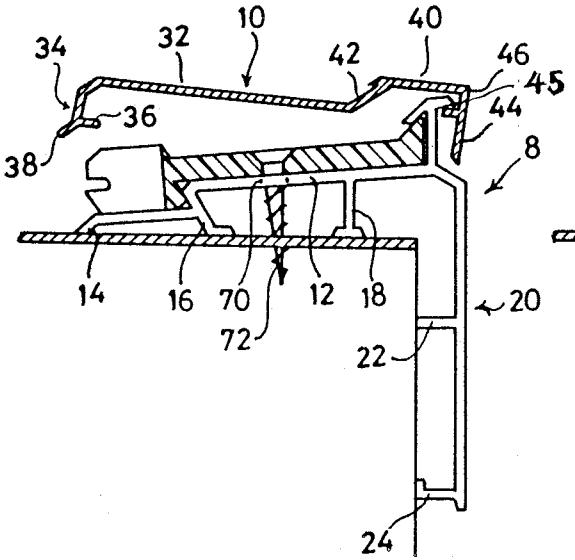
Figure 4A:
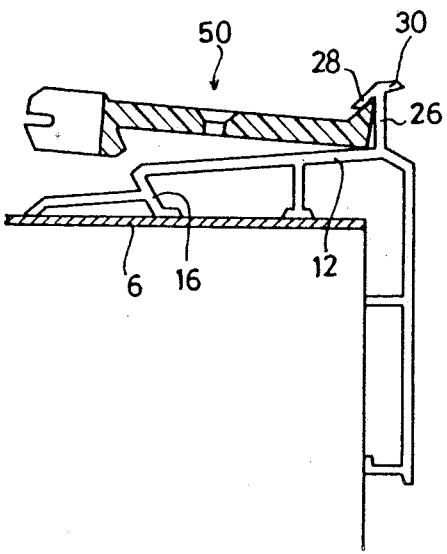
Figure 6:
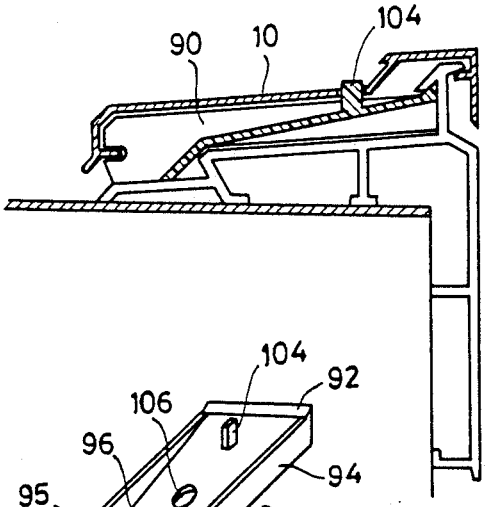
Figure 7:
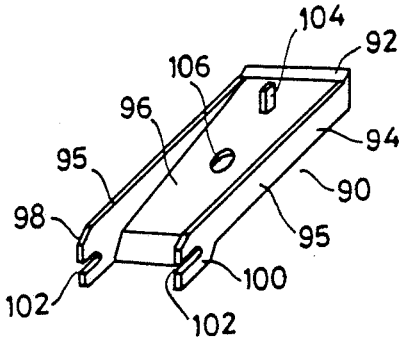
Figure 10:
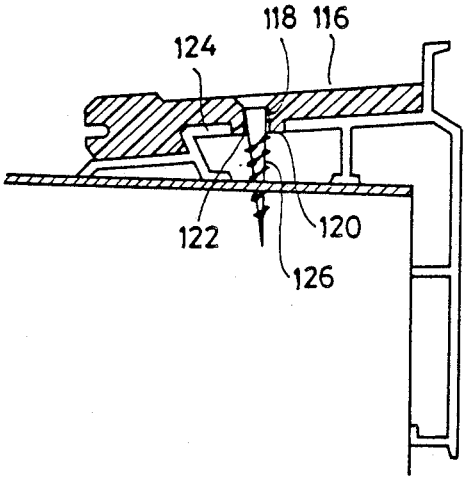
Figure 9:
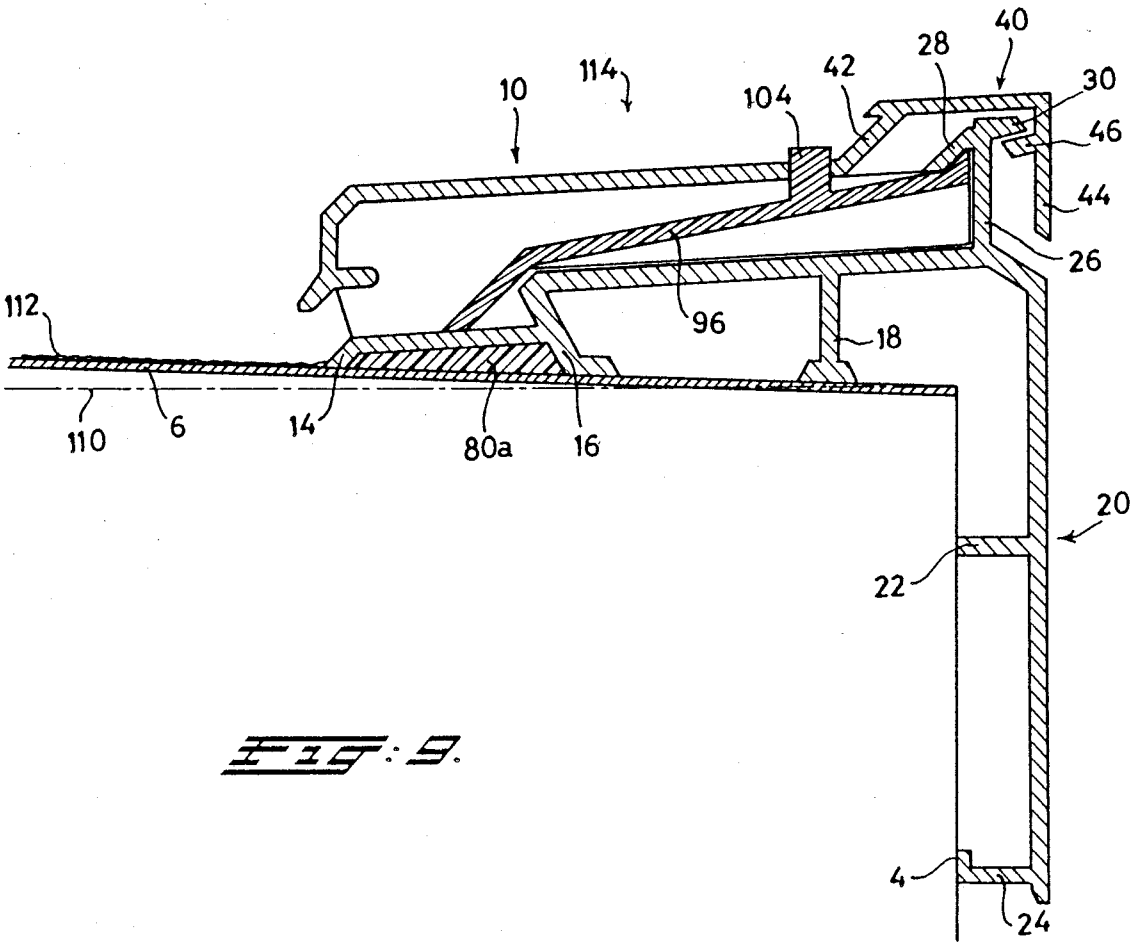

FIGS. 4*a*, 4*b*, 4*c* show the three stages of the fitting of coupling piece and second section respectively on the first section part;

FIG. 5 is an end view of the first section part combined with a strip of resiliently compressible material before fixing of said section part;

FIG. 6 shows in end view the effect of the presence of this material;

FIG. 7 shows a coupling piece to be used at the point where two second section parts adjoin each other;

FIG. 8 shows a cross-section at such a second coupling piece;

FIG. 9 shows this cross-section on an enlarged scale;

FIG. 10 shows a third embodiment of the coupling piece combined with the first section part.

DESCRIPTION OF PREFERRED EMBODIMENTS

In all figures reference numeral 2 indicates an eaves whose front wall is indicated by reference numeral 4; the usual roof covering material is indicated by reference numeral 6. The section system according to the invention comprises, as known per se, a first section part which is indicated in its entirety by 8, and a second section part which is indicated in its entirety by 10. The first section part 8 has a first covering strip 12 which rests by means of ribs 14, 15, 18 on the roof covering material 6 and a covering flange 20 which is connected to said covering strip and rests by means of the ribs 22, 24 against the front wall 4. There is also the upright rib 26 with the first end edge 28 facing the strip 12 at an angle of about 45° and the second end edge 30 standing at right angles thereto.

The second section part 10 comprises a covering strip 32 with a front edge 34 which stands virtually at right angles thereto, and which continues at one side into an end edge 36 standing virtually at right angles to said front edge and a covering flange 38 which is directed slanting downwards. At the other end the covering strip 32 merges into a slightly raised, essentially U-shaped part 40 with a front leg 42 and a second leg 44 bearing a locking rib 45 facing the front end of the section part 10.

While in the section system according to the state of the art the top section part is fixed on the bottom section part by means of locking screws going through one of the legs and acting on an upright part of the first section part, for which threaded holes have to be tapped in the first section part, according to the invention specially formed coupling pieces, which are indicated by 50 in the figures, are used. Such a coupling piece is made up of an essentially prismatic body part 52 containing a bore 54 with bevelled end edge, and with a raised end edge 56 at the rear end; the front end has a downward-slanting part 58 and ends in two resilient tongues 60, 62, each with a recess 64 and a bevelled front edge 63.

FIGS. 4*a*, 4*b*, 4*c* show how the second section part can be fixed on the first section part by means of this coupling piece, and how this coupling piece also facilitates the fitting of the first section part on the eaves. As can be seen from the figures, the configuration of the first end edge 56 and the second end edge 58 is complementary to that of the part enclosed by the covering strip 12, the upright rib 26 and the downward-slanting end edge 28—this end edge part fits closely into said space—while, on the other hand, the angle between the bottom wall of the body 52 of the coupling piece and the backward-slanting part 58 is equal to the angle between the forward-sloping rib 16 and the body part 12. The result is that a coupling piece 50 can be snapped firmly onto the first section part. These first section parts are supplied in discrete lengths to the user, accompanied by the correct number of coupling pieces, which have to be fitted at the correct intervals by the user and, of course, without the covering strip 12 of the section being pre-drilled at specific intervals. This eliminates not only a preliminary processing operation, but also an unpacking and packing operation: the section parts can be delivered on directly from the extrusion factory, still in the original pack, without the risk of damage. The coupling pieces 50 which, as stated, are provided with a pre-formed hole 54, are used as a drilling jig for ensuring that the fixing hole 70 through which the fixing screw 72 passes is drilled via this hole 54 in the correct place in the covering strip. An advantage of the presence of the coupling piece here is that the forces exerted during tightening of the screw are distributed over a much larger area than in the state of the art, so that denting and buckling are prevented and the intervals can be greater than those in the state of the art (double trim), which is, of course, an advantage. An excellent seal against the penetration of water is also obtained. So when the first section parts are fitted—of course, with the necessary play of 3 mm between adjacent section parts in order to permit thermal expansion—the second section parts can be placed in a simple manner on the first section parts locked in the manner shown in FIGS. 4*b* and 4*c*: the edge 46 of the second section part is slotted behind the edge 30 of the first section part and the front edge 34 of the second section part is pressed against the bevelled top edges 63 of the lips 60, 62; the lips open out and the end edge 36 comes to rest in the recesses 64. The situation according to FIG. 4*c*, in which the second section part 10 is fixed securely on the first section part, is then obtained.

It must be pointed out here that this fixing is such that even with great temperature fluctuations the second section part will not be able to come away from the first section part, while the second section parts can still be removed from the first section parts as desired: using a suitable tool, for example a wide screwdriver, the lips 60, 62 are pressed so far backwards and apart that the edge 36 is released from the recess 64, and the second section part can be pulled upwards. Removal by an unskilled, and unauthorized, person—and thus also theft—is virtually impossible.

The coupling pieces fitted at regular intervals on the first section part have another beneficial effect, which could be described as a "breakwater effect". In the state of the art the entire top surface of the first covering strip is clear, and rainwater can be forced in one direction under the influence of the wind and in the end can reach a gap between two adjoining section parts. The presence of the coupling pieces prevents this: only the water pushed over the surface lying between two coupling pieces can reach this gap.

As the figures show, there is a space between the ribs 14, 16 which can take a strip of compressible sealing material, in FIG. 5 indicated by 80. FIG. 5 shows the situation in which the first section part 8 is not yet fixed on the roof covering material 6 and the strip 80 has thus still the thickness of its unloaded state; FIG. 6 shows the situation in which the first section part is screwed tight, and the sealing material, here indicated by 80*a*, is fully compressed. It has already been stated above that a small interval must be present between two adjacent first section parts; as a result of the compression and the presence of this interval, the sealing material will go up through the small gap at the transition between two section parts, as shown by 80*b*, and will form an effective seal against water 84 flowing in along the roof covering material 6 in the direction of the arrow 82.

As known per se, the second section parts are fitted staggered relative to the first section parts, and a space of about 3 mm will also have to be present between the end edges of two adjacent second section parts to absorb the thermal expansion. Rainwater will be able to penetrate through these spaces to the first covering strip.

FIGS. 7, 8 and 9 show how with a modified design of the coupling piece rainwater which penetrates through the space between two adjacent top sections is prevented from spreading over the first covering strip. Like the coupling piece 50, this coupling piece 90, shown in these figures, has the upright end edge 92, but the body part 94 is designed with a forward-sloping top surface 96, while the locking lips 98, 100, each with a locking recess 102, lie in line with the side walls 95, running at the same height, of the body part 90, so that a sort of channel is formed. The top face 96 also has a lobe 104 projecting from it.

The hole 106 for a fixing screw can be formed in the body part, but this is not strictly necessary.

This coupling piece 90 is placed at the point where two top section parts 10 connect to each other; the lobe 104 here determines the distance between the second section parts. Rainwater which penetrates through the space present between the adjoining top covering strips is drained away by means of the sloping surface 96.

FIG. 9 shows the situation according to FIG. 8 on an enlarged scale; in this figure the sealing material 80*a* is shown as present in the space between the ribs 14 and 16, while this figure shows an eaves whose top surface, and thus also the surface of the roof covering material 6, does not run horizontally (the horizontal is indicated by 110, but slopes towards the front wall 4. Such a situation occurs frequently in practice and results in rainwater collection at one edge of the roof. Water on the roof, indicated by 112, will flow towards the eaves, but cannot pass the front rib 14; rainwater entering in the direction of the arrow 114 will actually be able to penetrate between two adjacent top sections, but will flow away downwards, since the surface 96 still slopes downwards. The penetration of rainwater to the edge of the roof covering material is thus largely avoided.

FIG. 10 shows in side view an embodiment of a coupling piece without raised end edge, which thus cannot be clamped onto the first section part. The coupling piece 116 shown in FIG. 10 is provided at the bottom side with a raised edge 120 which is formed around the hole 110, and which fits into a corresponding bore 122 provided beforehand in the covering strip 124. For fitting the coupling piece all that is necessary is to press the thickened part 120 into the bore 126 and then fit the fixing screw. In this case, too, a uniform distribution of the forces over the covering strip 124 is obtained and buckling thereof is prevented.

What is claimed is:

1. Eaves section system for emplacement on a roof, wherein the roof has covering material at its top and has an outside wall, the eaves section system comprising:

a first section part including a first covering strip extending over the roof covering material, and a downwardly directed covering flange attached to the first covering strip and extending down over the outside wall of the roof; an upright rib projecting up from the covering strip;

a second section part which is shaped for enclosing, in the second section part, the upright rib of the first section part the second section part including a second covering strip extending over the first covering strip; and a coupling piece fitted between the first and second covering strips where they extend over the roof covering material;

first coupling means spaced from the upright rib for coupling the coupling piece to the first covering strip, and second coupling means comprising a locking recess spaced from the upright rib for coupling the coupling piece to the second covering strip.

2. Eaves section system according to claim 1, wherein the first covering strip has a first front end, which is away from the attachment of the first covering strip to the covering flange, the first covering strip extends over the roof covering material to the first front end of the first covering strip;

the coupling piece having a respective second front end which extends generally to the first front end of the first covering strip;

the second covering strip having a respective third front end, and the second coupling means being at the third front end of the second covering strip, whereby the second covering strip extends from the upright rib to the second coupling means.

3. Eaves section system according to claim 2, wherein the second coupling means comprises the second front end of the coupling piece being resilient and said also including a locking recess defined in the second front end; the third front end of the second covering strip including an inwardly directed element thereon which is oriented for resiliently coupling into the recess in the second front end of the coupling piece.

4. Eaves section system according to claim 3, wherein the second coupling means further comprises two lips projecting in a V-shape from the coupling piece and together defining the resilient second front end of the coupling piece, and each of the lips being resiliently bendable outwardly away from the other lip; a respective one of the recesses being provided in each of the lips.

5. Eaves section system according to claim 2, wherein the upright rib from the first covering strip further comprises a first outwardly directed locking rib defined on the upright rib, and the first rib extends outwardly in a direction away from the first front end of the first covering strip;

a second inwardly directed locking rib being defined on the second section part, the second rib being oriented such that with the second section part enclosing the upright rib on the first section part, the second inwardly directed locking rib engaging behind the first outwardly directed locking rib on the first section part for engaging the second section part with the first section part at the upright rib.

6. Eaves section system according to claim 2, wherein the upright rib includes an inclined, forwardly facing portion thereof, which is inclined at an acute angle in the direction toward the first covering strip and toward the first front end of the first covering strip;

the coupling piece having a rear end thereof spaced from the second coupling means at the coupling piece, a raised edge at the rear end of the coupling piece for fitting into the space defined by the inclined forwardly facing portion of the upright rib, whereby the rear end of the coupling piece is held to the upright rib.

7. Eaves section system according to claim 6, wherein the first coupling means comprises the first covering strip including a second rib spaced from the upright rib further toward the first front end, and the second rib being angled rearwardly back toward the covering flange; and a snap-in edge defined on the coupling piece near the second coupling means, the snap-in edge being for fitting over the second rib and holding the coupling piece to the first covering strip.

8. Eaves section system according to claim 2, wherein the coupling piece has a generally prismatic body including a top face extending in the direction toward the second coupling means and toward the second front end of the coupling piece, and in that direction the top face sloping toward the roof covering material.

9. Eaves section system according to claim 8, further comprising a lobe projecting up from the top wall of the coupling piece body and being of a height to extend up to the second covering strip for serving as a spacer between the one second covering strip to which it extends and a neighboring one of the second covering strips.

10. Eaves section system according to claim 1, further comprising a bore through the coupling piece for receiving a fixing element, and a fixing element extending through the bore in the coupling piece and past the first section part for fixing the first section part above the roof covering material.

11. Eaves section system according to claim 10, wherein the coupling piece has a bottom side, a projecting part formed on the bottom side of the coupling piece around the bore therethrough; a corresponding recess defined in the first covering strip beneath the projecting part and the projecting part being fitted into the recess.

12. Eaves section system according to claim 1, further comprising ribs beneath the first covering strip at the roof covering material defining a space for reception of compressible sealing material between the first covering strip and the roof covering material.

* * * * *